US009441854B2

(12) United States Patent
Ramsay et al.

(10) Patent No.: US 9,441,854 B2
(45) Date of Patent: Sep. 13, 2016

(54) EXHAUST VENT

(71) Applicants: Serge Ramsay, Montreal (CA); Linda Ramsay, Montreal (CA)

(72) Inventors: Serge Ramsay, Montreal (CA); Linda Ramsay, Montreal (CA)

( * ) Notice: Subject to any disclaimer, the term of this patent is extended or adjusted under 35 U.S.C. 154(b) by 1008 days.

(21) Appl. No.: 13/649,175

(22) Filed: Oct. 11, 2012

(65) Prior Publication Data

US 2013/0196589 A1 Aug. 1, 2013

Related U.S. Application Data

(63) Continuation-in-part of application No. 13/419,500, filed on Mar. 14, 2012.

(60) Provisional application No. 61/475,892, filed on Apr. 15, 2011.

(51) Int. Cl.

| | |
|---|---|
| ***F24F 7/00*** | (2006.01) |
| ***F24F 13/14*** | (2006.01) |
| *D06F 58/20* | (2006.01) |

(52) U.S. Cl.

CPC ..... *F24F 13/1406* (2013.01); *F24F 7/00* (2013.01); *D06F 58/20* (2013.01); *F24F 2007/001* (2013.01); *F24F 2007/003* (2013.01); *F24F 2221/52* (2013.01)

(58) Field of Classification Search

CPC ..... F24F 7/00; F24F 2007/001; F24F 2007/2007; F24F 2007/003; F24F 2221/52

USPC ..... 454/359; 137/14, 516.29, 511, 527; 251/351, 333

See application file for complete search history.

(56) References Cited

U.S. PATENT DOCUMENTS

| | | | | |
|---|---|---|---|---|
| 3,584,566 | A | 6/1971 | McCabe | |
| 3,682,084 | A | 8/1972 | Tarnoff | |
| 3,842,722 | A | 10/1974 | Miller | |
| 4,237,621 | A | 12/1980 | Boismenu | |
| 4,530,170 | A | 7/1985 | Green | |
| 5,046,408 | A | 9/1991 | Eugenio | |
| 5,383,816 | A | 1/1995 | Marcello et al. | |
| 5,492,505 | A * | 2/1996 | Bell | B60H 1/249 137/855 |
| 5,568,947 | A | 10/1996 | Paquette | |
| 5,722,181 | A | 3/1998 | Meyer | |
| 5,727,999 | A * | 3/1998 | Lewis | B60H 1/249 137/527.8 |

(Continued)

FOREIGN PATENT DOCUMENTS

DE 102008044692 B3 * 1/2010 ..... F24F 13/0209

*Primary Examiner* — Steven B McAllister
*Assistant Examiner* — Frances F Hamilton
(74) *Attorney, Agent, or Firm* — Marshall, Gerstein & Borun LLP

(57) ABSTRACT

An exhaust which comprises a mounting plate mountable onto the external wall of the building and having an opening therein. The exhaust vent also comprises a main body attachable to the mounting plate and having a rear face, a front face, and an aperture extending from the rear face to the front face in fluid communication with the opening of the mounting plate and the conduit. The exhaust vent also comprises a flap pivotally attached to the main body and movable between a closed position, where the aperture is blocked by the flap, and an opened position where the flap extends away from the aperture. Finally the exhaust vent comprises a first seal which surrounds the aperture when the flap is in the closed position, the seal being located on either one of the flap or the main body. This invention aims at improving air-tightness of the exhaust vent when in the flap is in the closed position.

16 Claims, 10 Drawing Sheets

(56) References Cited

U.S. PATENT DOCUMENTS 5,909,748 A * 6/1999 LaCroix ..... F16K 17/0413 137/516.29
5,916,023 A 6/1999 Meyer
6,026,852 A * 2/2000 Barton ..... B29C 45/0062 137/512.1
6,299,529 B1 10/2001 Preston
6,302,788 B1 10/2001 Gagnon
6,682,415 B1 1/2004 Vagedes
6,772,538 B2 8/2004 Vagedes
6,780,100 B1 8/2004 Gretz
6,974,379 B2 12/2005 Koessler
7,137,405 B2 * 11/2006 Barrows ..... F16K 15/03 118/715
7,147,554 B1 12/2006 Berger
7,380,569 B2 * 6/2008 Takahashi ..... B67D 7/42 137/516.29
7,421,803 B2 * 9/2008 Charron ..... E04F 17/04 285/192
7,648,041 B2 * 1/2010 Ueda ..... H01L 21/67126 206/710
7,690,598 B1 * 4/2010 Plattner ..... B64D 13/02 244/129.1
7,988,544 B2 8/2011 Vanden Bosch et al.
8,033,900 B2 10/2011 Vanden Bosch et al.
2006/0025067 A1 2/2006 Koessler
2006/0099903 A1 * 5/2006 Bowler ..... B60H 1/00678 454/121
2009/0023379 A1 * 1/2009 Bredahl ..... F24F 13/082 454/267
2009/0114413 A1 5/2009 Daviau
2009/0280737 A1 * 11/2009 Jacak ..... F24F 11/043 454/358
2010/0105312 A1 * 4/2010 Bamberger ..... F24F 13/14 454/266
2012/0266975 A1 * 10/2012 Kelly ..... E04B 1/7038 137/357
2012/0291888 A1 * 11/2012 Bane ..... F16J 15/062 137/511

* cited by examiner

EXHAUST VENT

RELATED APPLICATION

The present application is a continuation-in-part of U.S. patent application Ser. No. 13/419,500 filed on Mar. 14, 2012, still pending.

FIELD OF THE INVENTION

The present invention relates to the field of venting devices. More particularly, it concerns exhaust vents such as the ones used in combination with apparatuses such as laundry dryers and bathroom or stove ventilators.

BACKGROUND

Exhaust vents or traps are well-known and commonly seen on exterior walls of buildings such as houses. They generally consist of a plate fixed to a side wall of a building and connected to an exhaust duct, and a flapper or damper hinged at the top of the plate. The exhaust duct is generally connected to a laundry dryer, a bathroom ventilator, a stove ventilator, and the like. Air exits the exhaust duct under the pressure produced by a fan or a blower, opening the flap or damper. When no air exits the duct, the flap lies against the plate in a closed position. In other types of exhaust vents, louvers or laths may be used instead of a single flapper.

Examples of known exhaust vents can be found in U.S. Pat. No. 3,682,084 to Tarnoff, U.S. Pat. No. 3,584,566 to McCabe, U.S. Pat. No. 6,772,538 to Vagedes, U.S. Pat. No. 6,974,379 to Koessler, U.S. Pat. No. 5,046,408 to Eugenio, as well as in US patent application no. 2009/0114413 to Daviau.

One of the major problems with existing exhaust vents provided with a hinged flapper or damper is that even when they are in a closed position, small apertures or gaps remain at the interface of the flapper and the plate, and air infiltration from the outside to the inside of the building can occur. This situation is particularly problematic in colder regions, where cold air from the outside enters the building or the house through these infiltration apertures.

Conversely, in warmer regions, or during warmer seasons, buildings and houses are often air-conditioned, and hot air from the outside often enters the house through these infiltration apertures. Furthermore, air that has been air-conditioned can also exit the houses or buildings through these exhaust vents even when the exhaust system is not in use, due to the fact that the flapper of the exhaust vent is not properly closed over the plate.

Another drawback of existing exhaust vents is the fact that an accumulation of snow near the exhaust vent can prevent the flapper or damper from opening properly, preventing air from exiting the exhaust duct. Conversely, high winds may also cause the flap of existing exhaust vents to open, thereby contributing to the above-described undesirable heat transfer.

In view of the above, there is a need for an improved exhaust which, by virtue of its design and components, would be able to overcome or at least minimize some of the above-discussed prior art concerns.

SUMMARY OF THE INVENTION

According to a first aspect of the present invention, there is provided an exhaust vent for allowing fluid to exit a building through a conduit opening on an external wall of the building. The exhaust vent comprises a mounting plate mountable onto the external wall of the building and having an opening therein. The exhaust vent also comprises a main body attachable to the mounting plate and having a rear face facing the building, a front face facing away from the building, an aperture extending from the rear face to the front face, a top portion, and a bottom portion. The opening of the mounting plate and the aperture of the main body are in fluid communication with the conduit. The exhaust vent also comprises a flap pivotally attached to the main body that is movable between a closed position, where the aperture is blocked by the flap, and an opened position where the flap extends away from the aperture, in response to a pressure of the fluid being expelled from the conduit. Finally the exhaust vent comprises a first seal located on either one of the flap or the main body for sealingly closing the aperture. The first seal surrounds the aperture when the flap is in the closed position.

In another embodiment, a second seal is provided on either one of the flap and the main body, for improving the sealed closure of the aperture. The second seal surrounds the first seal when the flap is in the closed position.

In an embodiment, the second seal is located along the perimeter of the front face of the main body.

In an embodiment, a portion of the front face of the main body is recessed. In this configuration a recessed area is formed and the flap is sized and shaped to fit within the recessed area of the main body.

In an embodiment, the flap is provided with an inner surface facing the front face of the main body and having a flange projecting therefrom. In this embodiment the first seal projects from the front face of the main body for abutting the inner surface of the flap when in the closed position. Furthermore, the recessed area of the main body is provided with a groove, the second seal is recessed within the groove and the flange of the inner surface of the flap fits within the groove, so as to abut the recessed second seal when in the closed position.

According to another aspect of the present invention, there is also provided an exhaust vent kit for assembling an exhaust vent allowing fluid to exit a building through a conduit opening on an external wall of the building. The exhaust vent kit comprises a mounting plate mountable on the external wall of the building, the mounting plate having an opening therein, as well as a main body attachable to the mounting plate. The main body has a rear face facing the building, a front face facing away from the building, an aperture extending from the rear face to the front face, a top portion, and a bottom portion. The opening of the mounting plate and the aperture of the main body are in fluid communication with the conduit. The exhaust vent kit further comprises a flap pivotally attachable to the main body. The flap is movable between a closed position where the aperture is blocked by the flap and an opened position where the flap extends away from the aperture, in response to a pressure of the fluid being expelled from the conduit. A first seal located on either one of the flap or the main body is also provided for sealingly closing the aperture. The first seal surrounds the aperture when the flap is in the closed position.

According to another aspect of the present invention, there is also provided an exhaust vent for allowing fluid to exit a building through a conduit opening on an external wall of the building. The exhaust vent comprises a mounting plate mountable on the external wall of the building and having an opening therein. The exhaust vent also comprises a main body attached to the mounting plate. The main body has a rear face facing the building, a front face facing away from the building, an aperture extending from the rear face to the front face, a top portion, and a bottom portion. The opening of the mounting plate and the aperture of the main body are in fluid communication with the conduit. Moreover, the bottom portion of the main body is thicker than the top portion, the front face being thus angled relative to the external wall of the building. The exhaust vent further comprises a support member located on a bottom section of the mounting plate, the support member supporting the bottom portion of the main body, and a flap pivotally attached to the main body. The flap is movable between a closed position where the aperture is blocked by the flap and an opened position where the flap extends away from the aperture, in response to a pressure of the fluid being expelled from the conduit. The flap has an inner surface facing the front face of the main body, the inner surface having a flange projecting therefrom. The exhaust vent further comprises a first seal located on the main body for sealingly closing the aperture. The first seal surrounds the aperture when the flap is in the closed position and projects from the front face of the main body for abutting the inner surface of the flap when in the closed position. Finally the exhaust vent also comprises a second seal recessed within the front face of the main body for improving the sealed closure of the aperture. The second seal surrounds the first seal when the flap is in the closed position, the flange of the inner surface of the flap abutting the recessed second seal when in the closed position.

BRIEF DESCRIPTION OF THE DRAWINGS

Other objects, advantages and features of the present invention will become more apparent upon reading the following non-restrictive description of preferred embodiments thereof, given for the purpose of exemplification only, with reference to the accompanying drawings in which.

DESCRIPTION OF A PREFERRED EMBODIMENT OF THE INVENTION

In the following description, the same numerical references refer to similar elements. The embodiments, geometrical configurations, materials mentioned and/or dimensions shown in the figures or described in the present description are preferred embodiments only, given solely for exemplification purposes.

Moreover, although the preferred embodiment of the exhaust vent and corresponding parts thereof consists of certain geometrical configurations as explained and illustrated herein, not all of these components and geometries are essential to the invention and thus should not be taken in their restrictive sense. It is to be understood, as also apparent to a person skilled in the art, that other suitable components and cooperation thereinbetween, as well as other suitable geometrical configurations, may be used for the exhaust vent according to the present invention, as will be briefly explained herein and as can be easily inferred herefrom by a person skilled in the art, without departing from the scope of the present invention. Moreover, it will be appreciated that positional descriptions such as "above", "below", "left", "right" and the like should, unless otherwise indicated, be taken in the context of the figures and should not be considered limiting.

Figure 1:
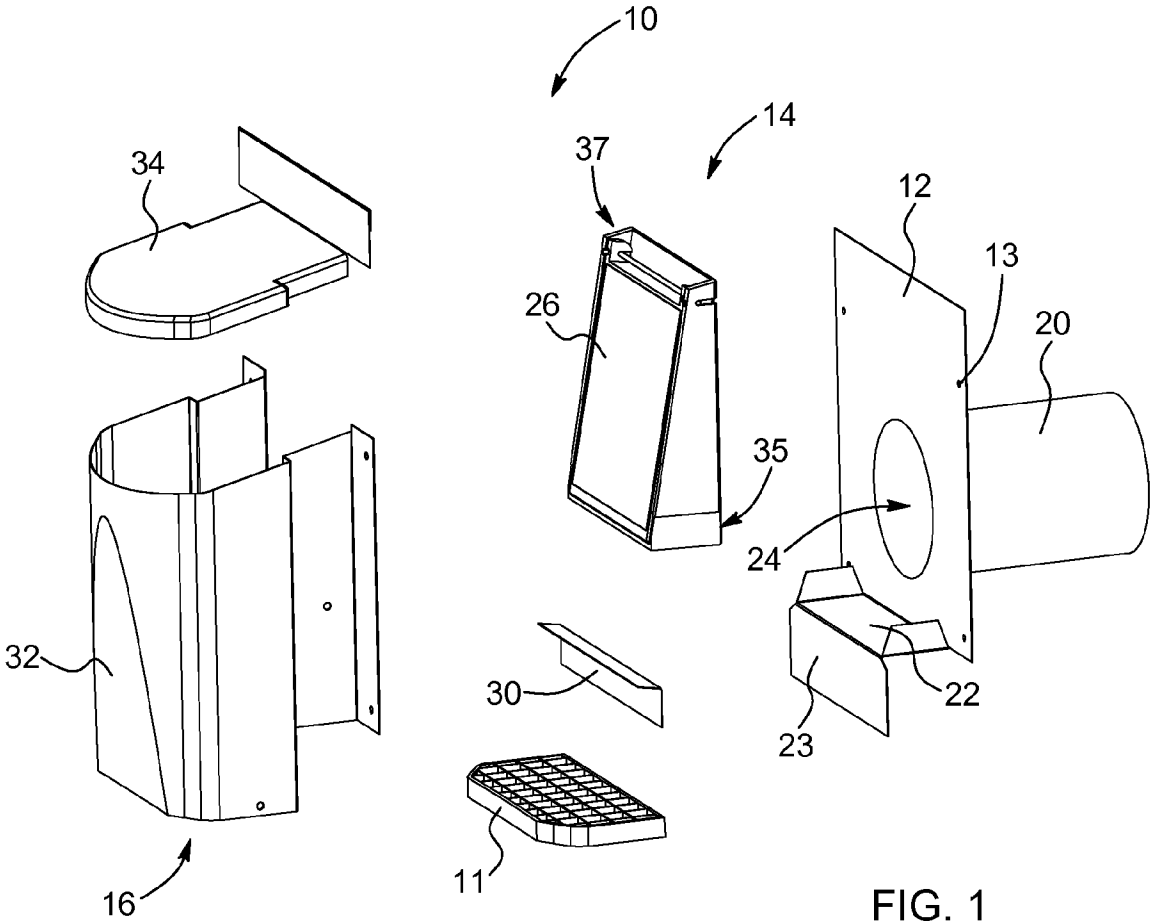
FIG. 1 is an exploded view of the exhaust vent, according to an embodiment of the invention.
Figure 2:
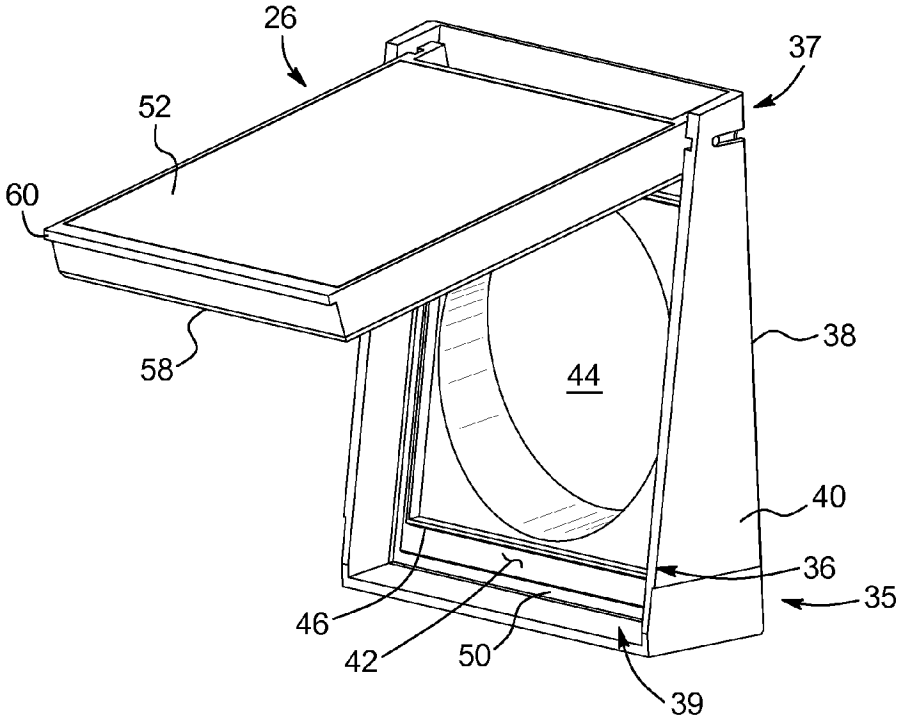
FIG. 2 is a perspective view of some of the components of the exhaust vent of FIG. 1, in an opened position.

Referring generally to FIGS. 1 and 2, in accordance with one embodiment of the present invention, there is provided an exhaust vent 10 which allows fluid to exit a building. The exhaust vent 10 includes a mounting plate 12, a main body 14, and a flap 26 pivotally mounted on the main body. As better shown in FIG. 2, the main body 14 includes an aperture 44. A first seal 46 surrounds this aperture 44 of the main body 14.

Even though, in the majority of cases, the substance to be expelled is air, in the course of the present application the term "fluid" is understood to be any substance that can flow through a conduit and may need to exit a building and includes different types of gases or liquids. Moreover, the term "building" is used herein to refer to any structure comprising ducts, pipes or the like, and from which fluid may need to be expelled, for example, and without being limitative, houses, apartment blocks, duplex or similar types of residential or commercial building.

Referring to FIGS. 1 to 4, the main body 14 of the exhaust vent 10 includes a rear face 38 which faces the building after being mounted thereon, and a front face 36 facing away from the building after being mounted thereon. The aperture 44 extends from the rear face 38 to the front face 36. In order to allow the aperture 44 to be closed when no fluid is being expelled through the exhaust vent 10, a flap 26 is pivotally connected to the main body 14. The main body 14 is mountable on the mounting plate 12, which will be described in more detail later in the description. The plate 12 can be mounted on an external building wall using known mounting techniques such as, without being limitative, gluing, screwing, welding, clipping or the like. Once the main body is mounted on plate 12, the aperture 44 of the main body 14 is aligned with the opening 24 of the mounting plate 12, both the aperture 44 and the opening 24 being in fluid communication with a conduit of the building in which the fluid to be expelled circulates. The term "conduit" should be understood to be any channel that conveys the fluid to be expelled, such as, without being limitative, a duct, pipe or the like.

Figure 3:
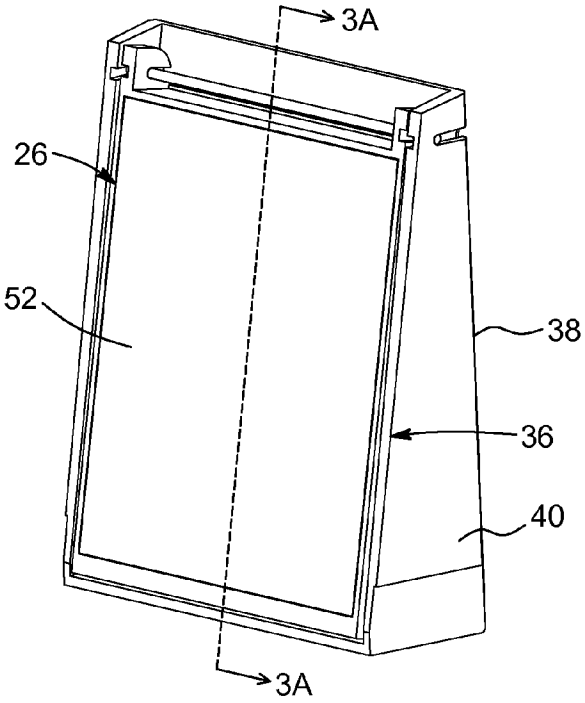
FIG. 3 is a perspective view of some of the components of the exhaust vent of FIG. 1, in a closed position.
Figure 3A:
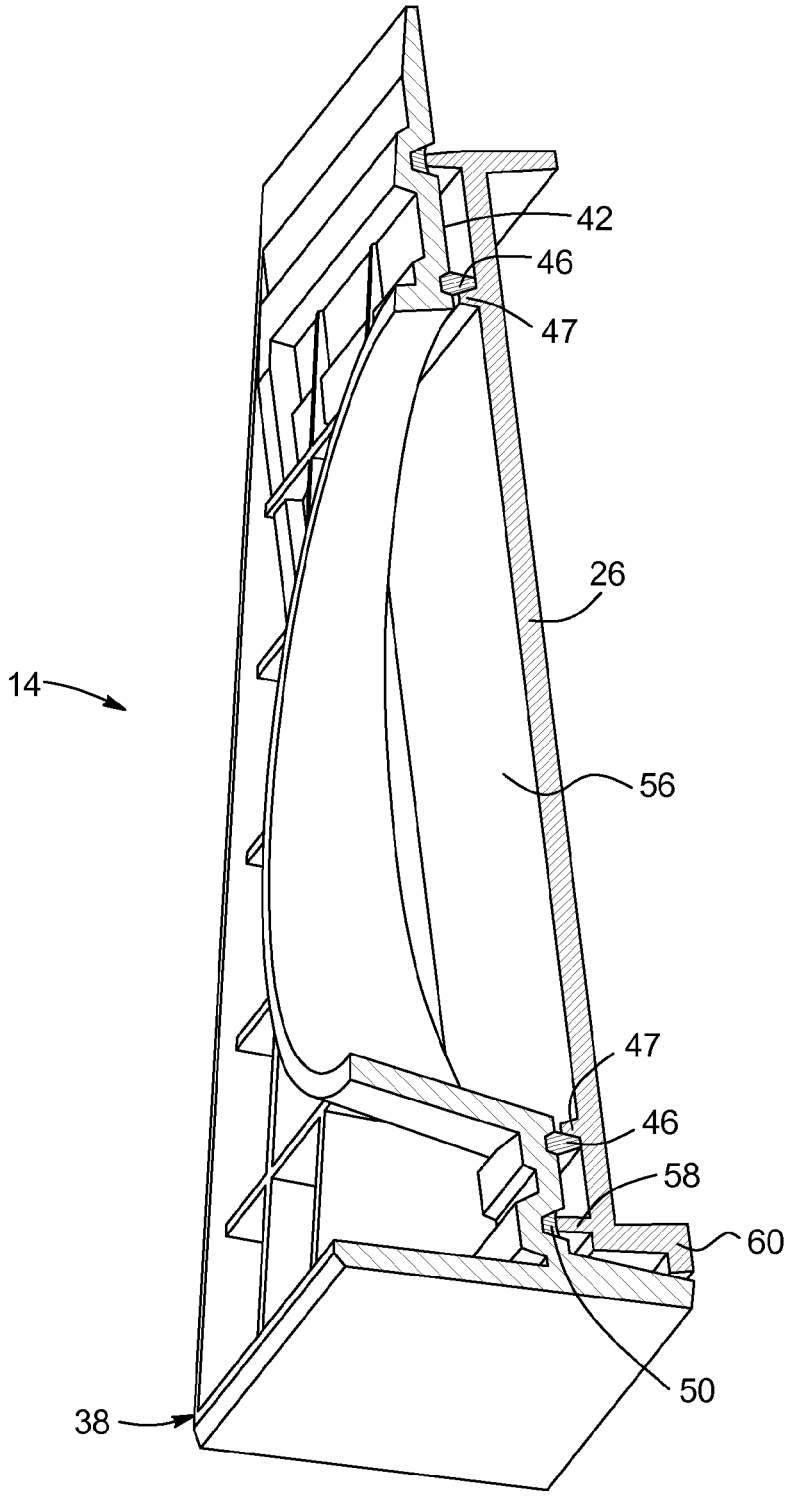
FIG. 3A is a perspective cross-sectional view of some of the components of the exhaust vent of FIG. 3 taken along line A-A, according to a preferred embodiment.
Figure 3B:
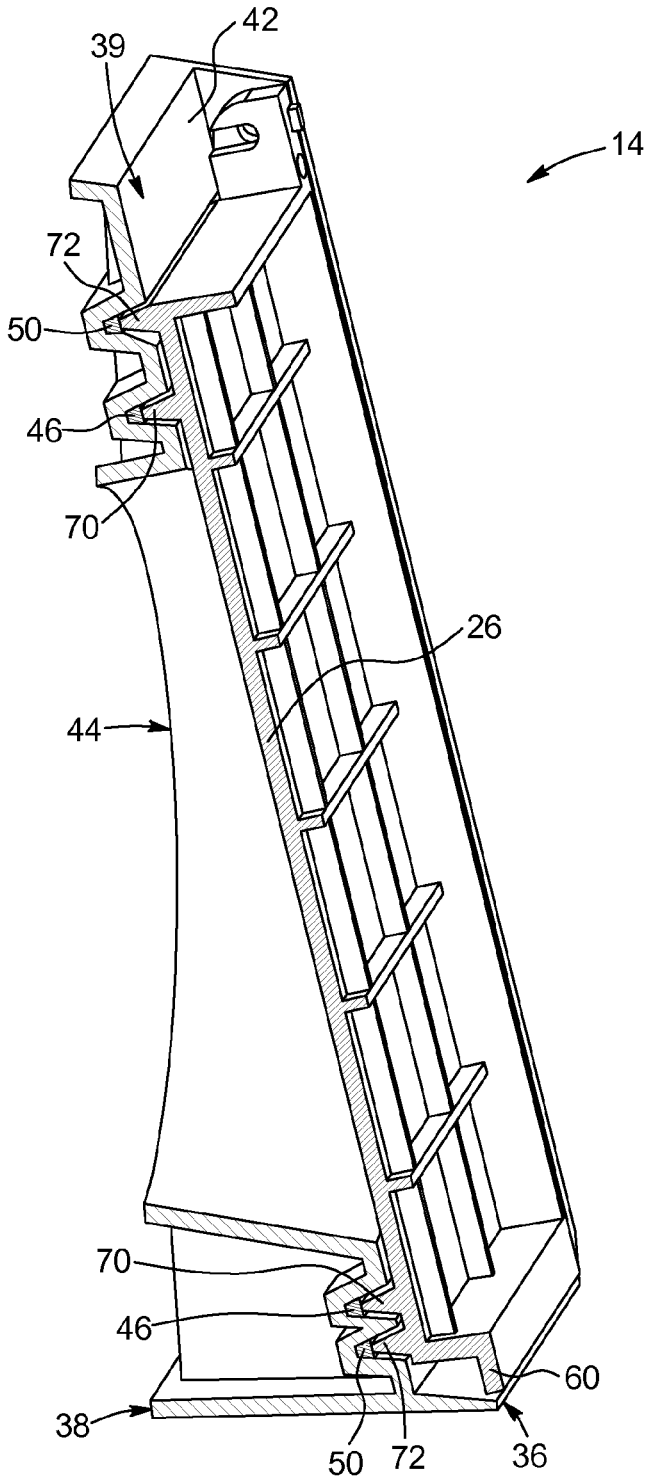
FIG. 3B is a perspective cross-sectional side view of some of the components of the exhaust vent of FIG. 3 taken along line A-A, according to another preferred embodiment.

The flap 26 is movable between a closed position, shown in FIGS. 3, 3A and 3B and an opened position shown in FIG.

2. In the closed position, the flap 26 abuts the front face of the main body 14 and blocks the aperture 44, thereby impeding fluid communication between the outside and the conduit of the building. In the opened position, the flap 26 extends away from the aperture 44 and allows fluid to exit through the exhaust vent 10. In operation, the flap 26 moves from the closed to the opened position in response to a pressure of the fluid being expelled from the conduit, and returns to the closed position when there is no sufficient pressure.

Figure 4:
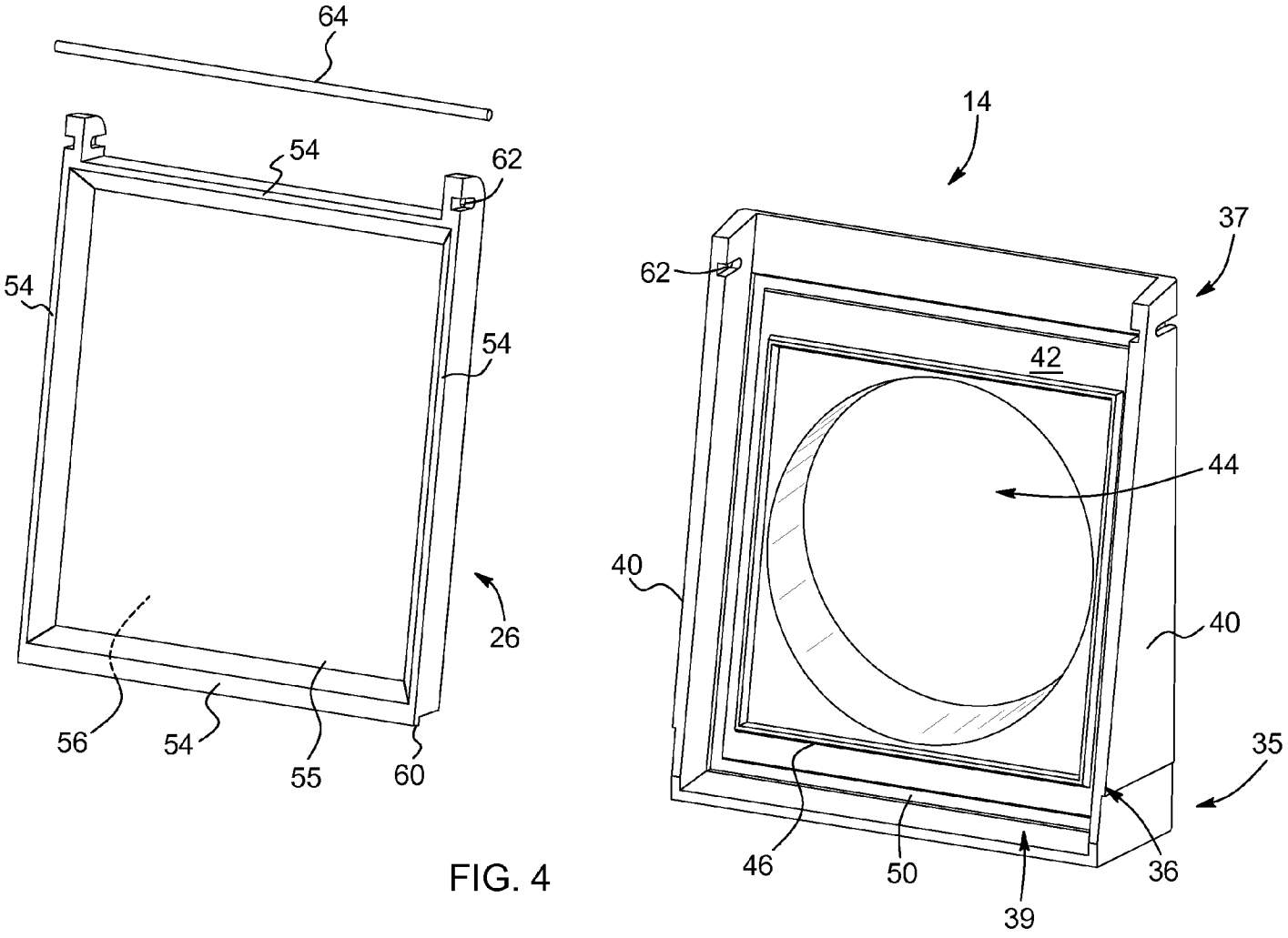
FIG. 4 is an exploded view of the components shown in FIGS. 2 and 3.

In the illustrated embodiment, and as better shown in FIG. 4, the pivoting capability of the flap may be provided by a pivoting rod 64 inserted in corresponding eyelets 62 located on upper portions of the main body 14 and the flap 26. One skilled in the art will however understand that any mechanism that would allow the flap to pivot from the closed to the opened position, and vice-versa, could be used without departing from the scope of the present invention.

In an embodiment, shown in FIGS. 2 and 3, the flap 26 receives an insulation layer 52, such as, without being limitative, an insulated foam or polystyrene layer, to prevent the occurrence of heat transfer through the flap. The insulating layer can be provided either on the outer 55 or inner 56 surface of the flap 26, and may cover only a section of the flap, preferably corresponding to the surface of the aperture 44 of the main body 14, or the entire surface.

In an embodiment, and as better shown in FIG. 4, the outer surface 55 of the flap 26 is recessed relative to lateral sides 54. This recessed configuration allows the insulation layer 52 to be inserted easily in the recessed portion of the flap 26, as can be seen on FIGS. 2 and 3.

It will be understood that an insulation layer may also be provided on the surface of the main body 14. In other embodiments, the main body 14 and/or the flap 26 can be provided with cavities, provided with air-tight and/or water-tight materials, such as felt, rubber and the likes.

In addition, it is possible to provide the flap 26 with biasing means, such as, without being limitative, spring, counterweight or the like, for biasing the flap 26 towards the closed position.

Still referring to FIGS. 1 to 4, in this preferred embodiment, the bottom portion 35 of the main body 14 is thicker than the top portion 37, providing the overall main body 14 a flared shape, when viewed from one of the sides 40. When the rear face 38 of the main body 14 is vertically aligned (as is generally the case when the exhaust vent 10 is mounted on a building wall), this difference in the thickness between the top 37 and the bottom 35 portions of the main body 14 results in the front face 36 forming an outward angle relative to the external wall of the building. This outward angle of the front face 36 is advantageous, as it helps improve the closure of the exhaust vent 10 when the flap 26 is in the closed position, thereby allowing a greater force to be applied to the front face 36 by the flap 26 because of the effect of gravity.

In the illustrated embodiments, the front 36 and rear 38 faces have a rectangular shape, however one skilled in the art will easily understand that these faces could have different shapes and sizes without departing from the scope of the present invention.

Still referring to FIGS. 1 to 4, a portion of the front face 36 of the main body 14 is recessed into the main body, thereby forming a recessed area 39. The recessed area 39 preferably covers most of the surface of the front face 36. The flap 26 is preferably sized and shaped to match the recessed area 39 and thereby fits within the recessed area 39 of the main body 14 when in the closed position. In this embodiment, when in the closed position, the flap 26 engages the back wall 42 of the recessed area 39 of the front face 36. In the illustrated embodiment, the flap 26 is provided with a flange 60 extending at the bottom of the flap 26.

This configuration in which the flap 26 is enclosed in the recessed area 39 when the flap 26 is in the closed position, offers several advantages. In particular, such a configuration helps protect the flap 26 from the effect of outside winds and therefore helps maintaining the flap 26 in the closed position in windy conditions. Moreover, having the flap recessed within the main body improves the overall tightness of the vent, given the fact that the seals are located in the recessed area and protected therein, thereby being favourable to the overall sealed closure of the vent 10. In the context of the present invention, the term "sealed closure" is understood in the art to mean a substantially hermetic seal which prevents the ingress and egress of fluids, debris, or the like.

As better seen in FIGS. 4 and 3A, in order to further provide improved sealed closure of the exhaust vent 10, when in the closed position, the exhaust vent 10 has a first seal 46 which surrounds the aperture 44 when the flap 26 is in the closed position. In the illustrated embodiment, the first seal 46 protrudes from the front face 36, more precisely from the back wall 42 of the recessed area 39 (as the front face 36 has a recessed area 39 in the illustrated embodiment) and surrounds the aperture 44 therein. Sealed closure of the exhaust vent 10 occurs when the flap 26 is in the closed position, as a result of the contact between the first seal 46 and the inner surface 56 of the flap 26. One skilled in the art will however understand that a similar result could be achieved by a seal 46 projecting from the inner surface 56 of the flap 26 and sized and shaped to surround the aperture 44 when contacting the front face 36 of the main body 14 (in the closed position). In the illustrated embodiment, a flange 47 protruding from the inner surface 56 of the flap 26 is further provided. The flange 47 is configured such that it comes in abutment with the side of the seal 46 when in the closed position, thereby increasing its resulting air-tightness.

In the illustrated embodiment, the first seal consists of a rubber joint, more precisely a joint made of Thermoplastic elastomer (TPE), but one skilled in the art will understand that other sealing materials such as, without being limitative, other types of polymers, foam, silicone, felt, or the like, could be used without departing from the scope of the present invention. Moreover, in the illustrated embodiment, the seal 46 has a rectangular shape; however, it will be understood that seals of other shapes, such as without being limitative, a round shape, an oval shape, a triangular shape, a polygonal shape, or the like, could be provided as long as it results in the first seal 46 surrounding the aperture 44.

In the embodiment shown in FIGS. 1 to 4, improved tightness of the exhaust vent is achieved by providing a second seal 50 which surrounds the first seal 46 when the flap 26 is in the closed position. In the illustrated embodiment, the second seal 50 is recessed into a groove of the front face 36, along a perimeter thereof. More precisely the second seal 50 is recessed into the back wall 42 of the recessed area 39 (as the front face 36 has a recessed area 39 in the illustrated embodiment) and is located along the perimeter of the recessed area 39. As best shown in FIG. 3A, in the case of the second seal 50, when the flap 26 is in the closed position, sealed closure is provided by the contact of a flange 58, running along the periphery of the inner surface 56 of the flap 26, with the second seal 50. Once again, it will be understood that a similar result could be achieved with a seal being recessed into the inner surface of the flap 26 and contacting the flange on the front face 36 of the main body, when in the closed position.

In an alternative embodiment shown in FIG. 3B, the first seal 46 and the second seal 50 are recessed into separate grooves of the front face 36. More precisely the first seal 46 and the second seal 50 are recessed into the back wall 42 of the recessed area 39 (as the front face 36 has a recessed area 39 in the illustrated embodiment). The first recessed seal 46 surrounds the aperture 44 and the second recessed seal 50 surrounds the first seal 46. In this embodiment, the flap 26 is provided with a first flange 70 and a second flange 72 projecting therefrom. The first flange 70 and the second flange 72 are sized and shaped to fit within the respective corresponding groove and abut the corresponding recessed seal when in the closed position. Therefore, when the flap 26 is in the closed position, sealed closure is provided by the contact of the first flange 70 with the first seal 46, and the contact of the second flange 72 with the second seal 50. Once again, it will be understood that a similar result could be achieved with the first seal 46 and the second seal 50 being recessed into the inner surface of the flap 26 and contacting flanges projecting from the front face 36 of the main body (or more precisely the back wall 42 of the recessed area 39 in the illustrated embodiment), when in the closed position.

The above-described dual seal arrangement, where a first and second seal 46, 50 are provided, is advantageous in that it provides an optimal overall tightness of the exhaust vent 10 to prevent cold air or humidity from penetrating into the building when the flap 26 is closed. However, one skilled in the art will understand that a single seal 46 surrounding the aperture 44 could be provided without departing from the scope of the invention. Moreover, when a second seal 50 is provided, this second seal 50 could be provided in a position other than the perimeter of the front face 36 of the main body 14, as long as the second seal 50 surrounds the first seal 46 when the flap 26 is closed.

Figure 5B:
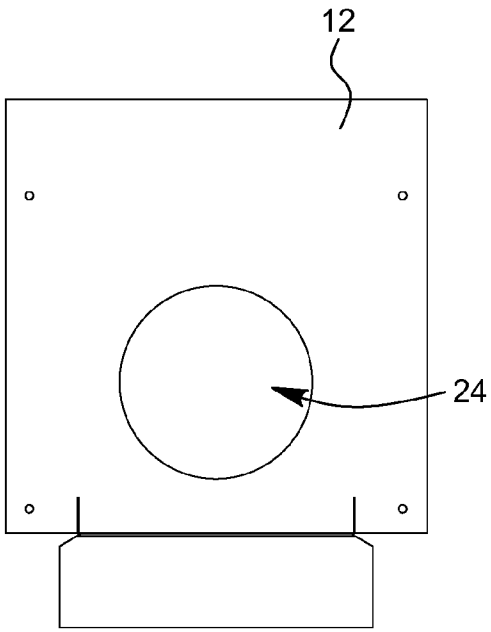
FIGS. 5, 5A and 5B are respectively a perspective view, a side view and a front view of a component of the exhaust vent of FIG. 1.
Figure 5A:
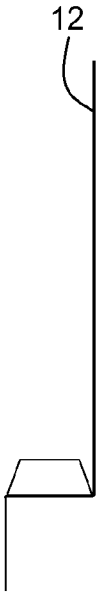
Figure 5:
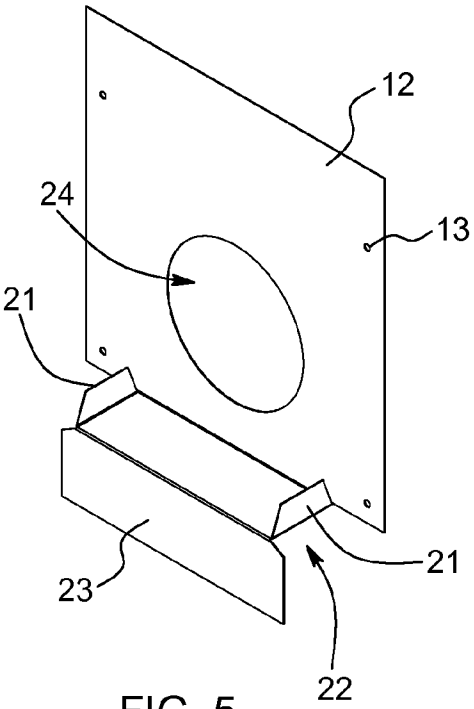
Figure 7:
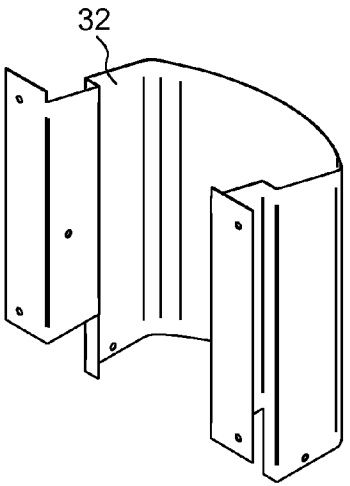
FIGS. 7 and 7*a* are respectively a back and a front perspective view of a component of the exhaust vent of FIG. 1.
Figure 7A:
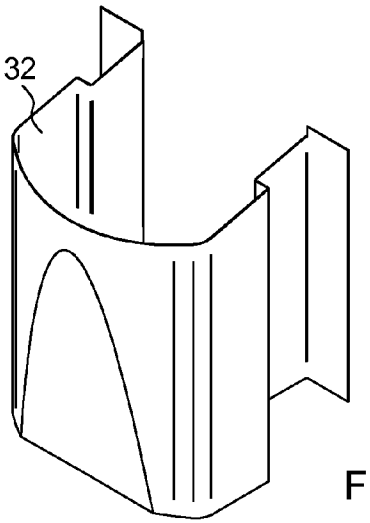
Figure 6:
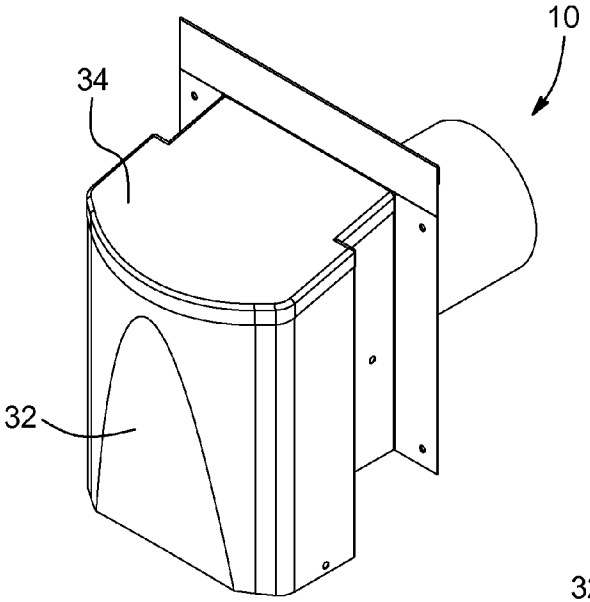
FIG. 6 is a perspective view of the assembled exhaust vent of FIG. 1.

Now referring to FIGS. 1 and 5 to 5*b*, the main body is preferably connected to the mounting plate 12. The mounting plate 12 is provided with an opening 24 which allows the fluid to flow through the mounting plate 12. The mounting plate 12 can generally be defined as a flat piece of a rigid material devised to be mounted on the external wall of the building. Preferably, the mounting plate 12 is made of metallic material, such as, without being limitative, galvanized steel or aluminum but any other materials providing sufficient rigidity, such as plastic, could be used. The mounting plate 12 can be mounted on the wall of a building using known mounting techniques such as, without being limitative, screws, nails, other mechanical fasteners, and/or the like. In order to allow easy installation of the mounting plate on the exterior wall of the building, in the illustrated embodiment, screw holes 13 are provided at every corner, to allow the mounting plate 12 to be easily screwed onto a wall by a user.

As previously mentioned, the main body 14 may be attached to the mounting plate 12, using known mounting techniques. In order to allow the main body to be in fluid communication with the conduit, the positioning of the main body 14 on the mounting plate 12 should be such that the apertures of the main body 44 and the mounting plate 24 are aligned. One skilled in the art will understand that perfect alignment is not required, but the apertures must share a communication channel allowing fluid to flow. Similarly, the size and shape of the aperture 44 of the main body 14 and the aperture 24 of the mounting plate 12 preferably match to maximize fluid flow, but could differ without departing from the scope of the present invention.

In the illustrated embodiment, a connector 20 extends from the back face of the mounting plate 12 to allow easy connection between the conduit of the building and the mounting plate 12. The size and shape of the connector 20, at the interface of the connector 20 and the mounting plate 12, preferably matches that of the opening 24, in order to optimize fluid exchange through the opening 24. Therefore the size and shape of the opening 24 and the connector 20 are preferably similar. However, the size and shape of the connector 20 may shift towards the mounting plate 12 to conform to that of the opening 24. In the illustrated embodiment, the connector 20 and opening 24 have a circular configuration; however, it will be understood that connectors 20 and/or openings 24 having different configurations could be provided in order to match the shape and sizes of the duct or pipe to which it is to be connected to. The same could be said for the opening 44 of the main body 14, which may have a different size than that of the illustrated embodiments. In an alternative embodiment, no connector 20 could be provided, the duct or pipe therefore being connected directly onto the mounting plate 12 or the main body 14.

Still referring to the illustrated embodiment of FIGS. 1 and 5 to 5*b*, the mounting plate 12 may further be provided with a support member 22 located at a bottom of the mounting plate 12. The support member 22 is a section extending perpendicularly from the mounting plate 12 and away from the external wall of the building the plate 12 is mounted on. When provided, the support member 22 helps support the bottom portion 35 of the main body 14, as the bottom portion 35 of the main body 14 abuts the support member 22.

It should be understood that the term perpendicular should not be interpreted in a restrictive manner in the context of the present document, and that the support member 22 need not be exactly perpendicular to the mounting plate 12 and could have a downward or upward inclination without departing from the scope of the present invention.

In the illustrated embodiment, the support member 22 is a bent plate which is integral to the mounting plate 12. However one skilled in the art will easily understand that the support member 22 could be a distinct component joined to the mounting plate 12 by known mounting techniques such as, without being limitative, gluing, welding, screwing, riveting, or any other method of joining two components. Moreover, the support member 22 is preferably made of the same material as the mounting plate 12, but could be made of a different material without departing from the scope of the present invention.

In the embodiment shown in FIGS. 1 and 5 to 5*b*, the support member 22 further comprises first and second lateral flanges 21 located on opposite sides of the support member 22 and projecting upwardly therefrom. The lateral flanges 21 offer a greater stability to the main body 14 attached to the mounting plate 12, as they frictionally engage the lateral sides 40 of the main body 14 and help maintain the main body 14 in place. Greater stability can be achieved by bending the flanges 21 inwardly towards one another in order to increase the friction between the flanges 21 and the lateral sides 40 of the main body 14.

Figure 8A:
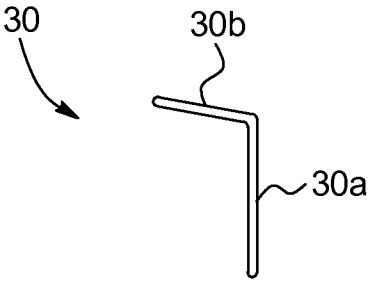
FIGS. 8 and 8A are respectively a perspective view and a side view of another component of the exhaust vent of FIG. 1.
Figure 8:
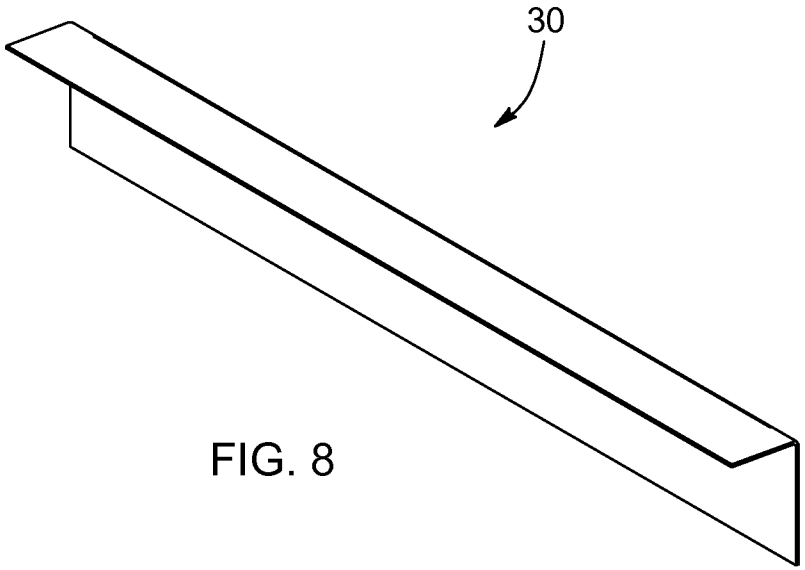

In an embodiment, and as better shown in FIGS. 1 and 8 to 8*a*, a deflector, or baffle 30, is connected to the support member 22. The deflector 30 serves the double function of deflecting air expelled by the conduit away from the main body 14 and shielding the interface of the flap 26 with the main body 14 from outside conditions. The shielding provided by the deflector 30 helps prevent outside air from entering into the building through the aperture 44 by preventing the flap 26 from being opened by outside winds.

The deflector 30 is a sheet of rigid material such as, without being limitative, metal or plastic, which is located under the bottom section 35 of the main body 14 and which extends forwardly beyond the main body in order to deflect outside air near the interface of the flap 26 and the bottom section 35 of the main body 41. The deflector can be integral to either one of the main body 14 or the support member 22 of the mounting plate 12, or can alternatively be connected to the main body 14 or the support member 22 through known mounting techniques such as, without being limitative, gluing, welding, screwing, riveting, or any other method of joining two components.

As better seen in FIGS. 1 and 8 to 8*a*, the deflector preferably has a first deflecting section 30*a* and a second deflecting section 30*b*. The first deflecting section 30*a* is connectable to the downwardly bent portion 23 of the support member 22. Preferably, the deflecting section 30*b* forms an obtuse angle with the first section 30*a*, the angle between the two sections preferably being between 90 and 120 degrees. One skilled in the art will understand that in an embodiment the angle between the two sections could be outside of the specified range.

One skilled in the art will understand that in an alternative embodiment (not shown) the main body 14 and the connecting plate 12 could be designed as an integral component connectable to a conduit and mountable on an external wall of a building.

The exhaust vent 10 also preferably includes an exhaust box 16, provided with a front box 32 and a cover plate 34 to enclose the main body 14 therein. In the illustrated embodiment, the cover plate 34 is laid over the front box 32 such as to form a protective space protecting the main body 14 from wind, snow, rain or even small animals. The front box and cover plates 32, 34 are preferably made of bent metallic plates; however, other materials can be considered, such as, without being limitative, moulded plastic. One skilled in the art will easily understand that in an alternative embodiment, the front box and cover plates 32, 34 could be formed as a single component. The exhaust box 16 could be attached to the mounting plate 12 or the external wall through known mounting techniques such as, without being limitative, gluing, welding, screwing, riveting, or any other method of joining two components.

The top cover 34 of the exhaust box 16 is preferably downwardly inclined for preventing rain or snow from accumulating on top of the exhaust box 16. The exhaust box 16 not only prevents accumulation of debris such as snow or leaves in front of the main body 14 but also provides a more aesthetic look to the exhaust vent 10. Accumulation of debris in front of the flap 26 is obviously undesirable, as it can prevent the flap 26 from opening and thus prevent air from being ventilated outside the building.

As can better be seen in FIG. 1, the exhaust box 16 can also be provided with a guard 11 located underneath the vent and connectable to the exhaust box 16. The guard 11 is provided with at least one opening, allowing air expelled from the building to exit the exhaust box 16. Preferably, the guard 11 is a grid allowing air to be expelled, but also preventing small animals such as birds, squirrels or rats from entering the building through the valve 14.

Figure 9:
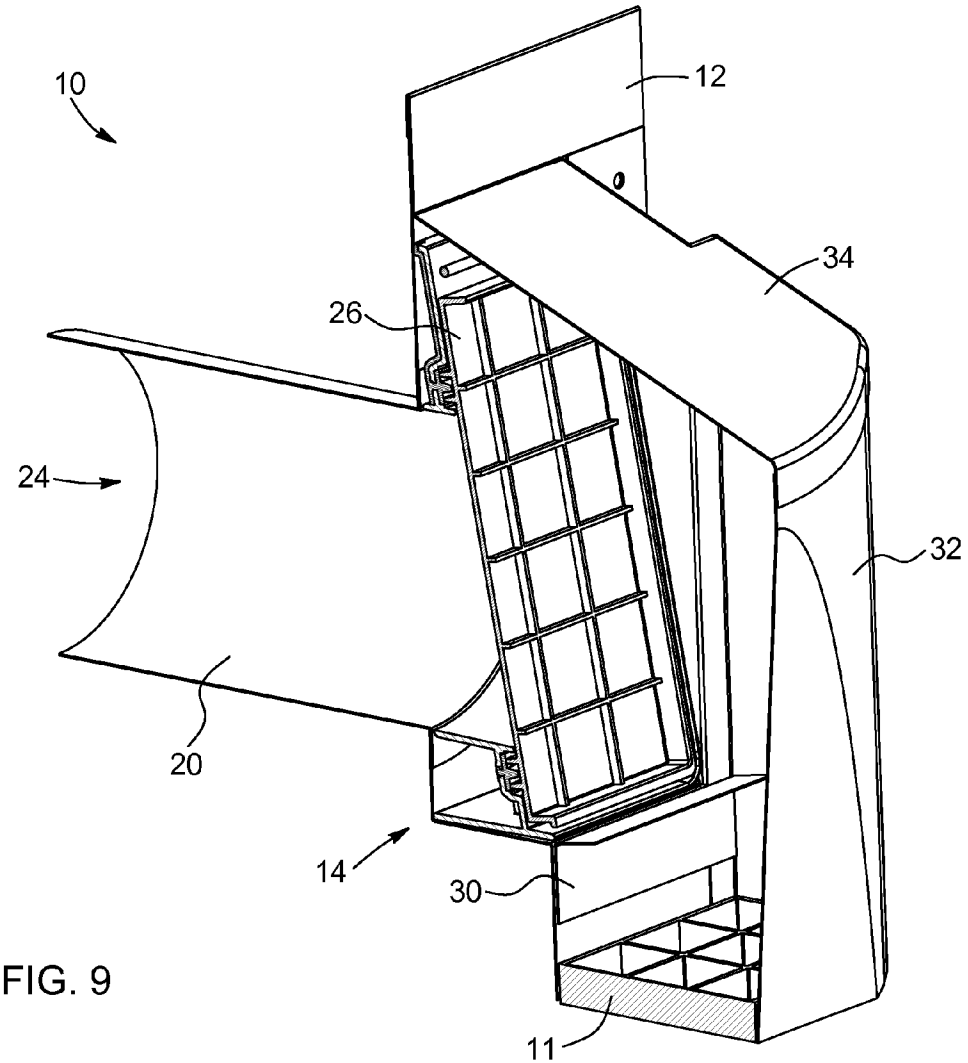
FIG. 9 is a perspective cross-sectional view of the exhaust vent, according to an embodiment of the invention.

Referring to FIG. 9, yet another embodiment of an exhaust vent 10 is shown. This embodiment of the exhaust vent is similar to the one shown in FIG. 1, the sealing arrangement being slightly different.

Figure 9A:
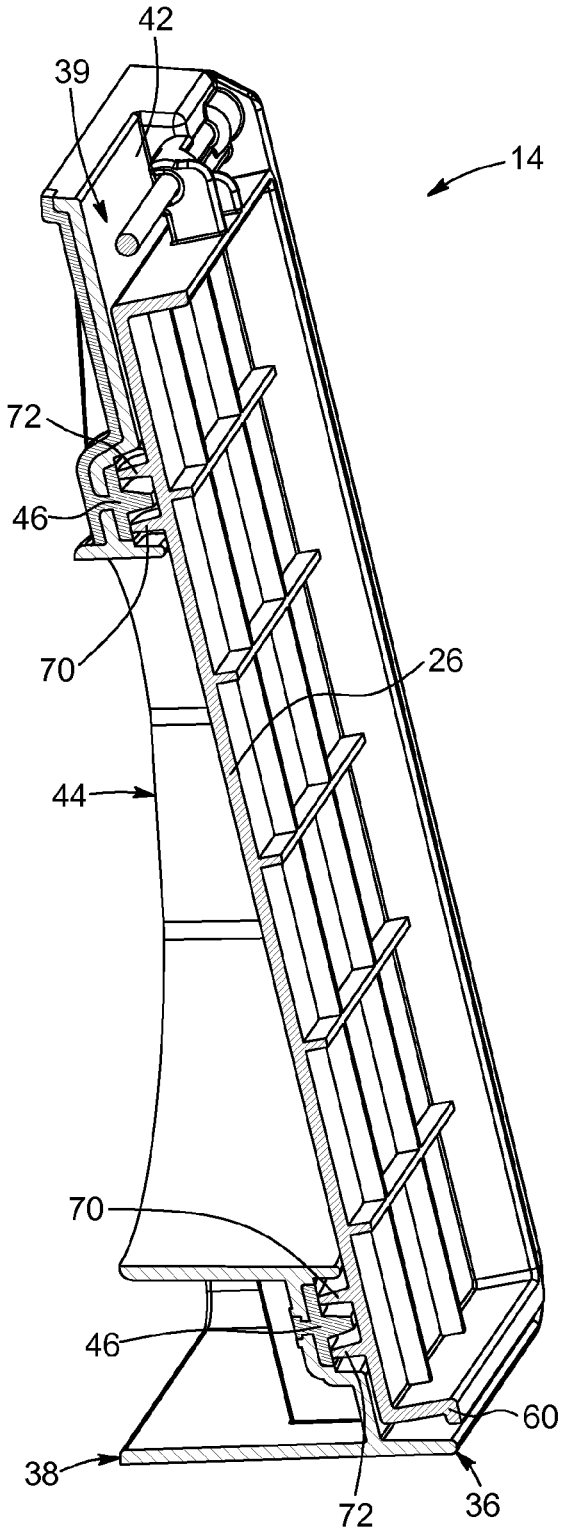
FIG. 9A is a perspective cross-sectional side view of some of the components of the exhaust vent of FIG. 9.

Referring now to FIG. 9A, the first seal 46 is recessed in a groove of the front face of the main body. More precisely the first seal 46 is recessed in the back wall of the recessed area 39 (the front face having a recessed area 39 in the illustrated embodiment). The first recessed seal 46 surrounds the aperture 44. The seal has a T-shape profile, defining two outer seal portions, and central protruding portion. The flap 26 is provided with a first flange 70 and a second flange 72 projecting therefrom. The first flange 70 and the second flange 72 are sized and shaped to abut the corresponding outer portion of the seal 46 when in the closed position. Therefore, when the flap 26 is in the closed position, sealed closure is provided by the contact of the first flange and second flanges 70, 72 with the respective outer portions of the seal 46. Once again, it will be understood that a similar result could be achieved with the first seal 46 being recessed into the inner surface of the flap 26 and contacting flanges projecting from the front face 36 of the main body when in the closed position. Preferably, the protruding central portion abuts the flap 26, between the two flanges 70, 72. Still preferably, the protruding central portion of the first closely fits between the flanges 70, 72, improving sealing of the flap with the main body.

As it can be appreciated, the exhaust vent 10 of the invention allows an improved sealed closure of the valve 14 when no air is expelled from the conduit to which it is connected. In these difficult economic times when the costs of energy keep increasing, avoiding heat transfer and/or losses through the exhaust vent is highly desirable. The exhaust vent 10 of the invention advantageously prevents such undesired heat transfer.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive.

The invention claimed is:

1. An exhaust vent for allowing fluid to exit a building through a conduit opening on an external wall of the building, the exhaust vent comprising:

a mounting plate mountable on the external wall of the building, the mounting plate having an opening therein;

a main body attachable to the mounting plate, the main body having a rear face facing the building, a front face facing away from the building, an aperture extending from the rear face to the front face, a top portion, and a bottom portion, the opening of the mounting plate and the aperture of the main body being in fluid communication with the conduit, the bottom portion of the main body being thicker than the top portion, providing the main body with a flared shape when viewed from the side, the front face being thus angled relative to the external wall of the building;

a flap pivotally attached to the main body, the flap being movable between a closed position wherein the aperture is blocked by the flap and an opened position wherein the flap extends away from the aperture in response to a pressure of the fluid being expelled from the conduit; and a seal located on either one of the flap or the main body for sealingly closing the aperture, the seal surrounding the aperture when the flap is in the closed position.

2. The exhaust vent according to claim 1, wherein a portion of the front face of the main body is recessed, thereby forming a recessed area, the flap being sized and shaped to fit within the recessed area of the main body.

3. The exhaust vent according to claim 2, wherein:

the flap is provided with an inner surface facing the front face of the main body; and the seal projects from the front face of the main body for abutting the inner surface of the flap when in the closed position.

4. The exhaust vent according to claim 2, wherein:

the flap has an inner surface facing the front face of the main body, the inner surface having a flange projecting therefrom; and the recessed area of the main body is provided with a groove, the seal being recessed within the first groove, the flange of the inner surface of the flap fitting within the groove, and abutting the recessed seal when in the closed position.

5. The exhaust vent according to claim 1, wherein the mounting plate has a bottom portion provided with a support member for supporting the bottom portion of the main body mounted thereon, the support member extending perpendicularly relative to the mounting plate and away from the external wall of the building when mounted thereon.

6. The exhaust vent according to claim 5, wherein the support member further comprises first and second lateral flanges projecting upwardly therefrom, the first and second lateral flanges being bended inwardly such that they frictionally engage the bottom portion of the main body.

7. The exhaust vent according to claim 1, wherein the flap is further provided with an insulation layer, the insulation layer of the flap preventing heat transfer from occurring through the flap.

8. The exhaust vent according to claim 1, wherein a deflector is further provided, the deflector being mountable on the mounting plate, below the main body, for preventing outside air from opening the flap.

9. The exhaust vent according to claim 1, wherein the main body is integral to the mounting plate.

10. The exhaust vent according to claim 1, further comprising an exhaust box connectable to the mounting plate, the exhaust box being provided with openings for allowing the fluid to be expelled from the conduit, the exhaust box forming an intermediate space between the conduit and the outside air.

11. The exhaust vent according to claim 1, wherein:

the flap has an inner surface facing the front face of the main body, the inner surface having a first flange and a second flange projecting therefrom;

the front face of the main body is provided with a groove, the seal being recessed within the groove, the seal having a T-shape profile defining two outer portions and a central protruding portion;

the first and second flanges being sized and shaped to abut the respective outer portions of the seal when in the closed position, enclosing the protruding central portion between said first and second flanges.

12. An exhaust vent kit for assembling an exhaust vent allowing fluid to exit a building through a conduit opening on an external wall of the building, the exhaust vent kit comprising:

a mounting plate mountable on the external wall of the building, the mounting plate having an opening therein;

a main body attachable to the mounting plate, the main body having a rear face facing the building, a front face facing away from the building, an aperture extending from the rear face to the front face, a top portion, and a bottom portion, the opening of the mounting plate and the aperture of the main body being in fluid communication with the conduit, the bottom portion of the main body being thicker than the top portion, providing the main body with a flared shape when viewed from the side, the front face being thus angled relative to the external wall of the building;

a flap pivotally attached to the main body, the flap being movable between a closed position wherein the aperture is blocked by the flap and an opened position wherein the flap extends away from the aperture in response to a pressure of the fluid being expelled from the conduit; and a seal located on either one of the flap or the main body for sealingly closing the aperture, the seal surrounding the aperture when the flap is in the closed position.

13. The exhaust vent kit according to claim 12, wherein:

the flap has an inner surface facing the front face of the main body; and the seal projects from the front face of the main body for abutting the inner surface of the flap when in the closed position.

14. The exhaust vent kit according to claim 12, wherein:

the flap has an inner surface facing the front face of the main body, the inner surface being provided with a flange projecting therefrom;

the front face of the main body is provided with a recess, the seal being located within the recess, the flange of the inner surface of the flap abutting the recessed seal when the flap is in the closed position.

15. The exhaust vent kit according to claim 12, wherein a portion of the front face of the main body is recessed, thereby forming a recessed area, and the flap being sized and shaped to fit within the recessed area of the main body.

16. An exhaust vent for allowing fluid to exit a building through a conduit opening on an external wall of the building, the exhaust vent comprising:

a mounting plate mountable on the external wall of the building, the mounting plate having an opening therein;

a main body attached to the mounting plate, the main body having a rear face facing the building, a front face facing away from the building, an aperture extending from the rear face to the front face, a top portion, and a bottom portion, the opening of the mounting plate and the aperture of the main body being in fluid communication with the conduit, the bottom portion of the main body being thicker than the top portion, providing the main body with a flared shape when viewed from the side, the front face being thus angled relative to the external wall of the building;

a support member located on a bottom section of the mounting plate, the support member supporting the bottom portion of the main body;

a flap pivotally attached to the main body, the flap being movable between a closed position wherein the aperture is blocked by the flap and an opened position wherein the flap extends away from the aperture in response to a pressure of the fluid being expelled from the conduit, the flap having an inner surface facing the front face of the main body, the inner surface having a first flange and a second flange projecting therefrom;

a seal recessed within the front face of the main body for sealingly closing the aperture, the seal surrounding the aperture and the first and second flanges being sized and shaped to abut the respective outer portions of the seal when in the closed position.

* * * * *